US011448217B2

(12) United States Patent
Hase et al.

(10) Patent No.: US 11,448,217 B2
(45) Date of Patent: Sep. 20, 2022

(54) GAS COMPRESSOR

(71) Applicant: Hitachi Industrial Equipment Systems Co., Ltd., Tokyo (JP)

(72) Inventors: Masakazu Hase, Tokyo (JP); Hideharu Tanaka, Tokyo (JP); Akira Iyozumi, Tokyo (JP); Masahiko Takano, Tokyo (JP); Kenji Morita, Tokyo (JP); Shigeyuki Yorikane, Tokyo (JP); Takashi Nakajima, Tokyo (JP); Yoshihiko Sagawa, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 92 days.

(21) Appl. No.: 17/043,370

(22) PCT Filed: Mar. 26, 2019

(86) PCT No.: PCT/JP2019/012697

§ 371 (c)(1),
(2) Date: Sep. 29, 2020

(87) PCT Pub. No.: WO2019/189085

PCT Pub. Date: Oct. 3, 2019

(65) Prior Publication Data

US 2021/0017988 A1 Jan. 21, 2021

(30) Foreign Application Priority Data

Mar. 30, 2018 (JP) ..... JP2018-066556
Mar. 30, 2018 (JP) ..... JP2018-066558

(51) Int. Cl.
*F04C 28/24* (2006.01)
*F04C 28/08* (2006.01)
(Continued)

(52) U.S. Cl.
CPC ..... *F04C 28/24* (2013.01); *F04B 49/08* (2013.01); *F04C 18/16* (2013.01); *F04C 28/06* (2013.01);
(Continued)

(58) Field of Classification Search
CPC ..... F04B 49/08; F04C 28/06; F04C 28/08; F04C 28/10; F04C 28/24; F04C 18/16;
(Continued)

(56) References Cited

U.S. PATENT DOCUMENTS 9,399,995 B2 * 7/2016 Park ..... F04D 27/001

FOREIGN PATENT DOCUMENTS

JP 9-287580 A 11/1997
JP 2005-16414 A 1/2005
JP 2012-2156 A 1/2012

OTHER PUBLICATIONS

International Search Report (PCT/ISA/210) issued in PCT Application No. PCT/JP2019/012697 dated Jul. 16, 2019 with English translation (two (2) pages).

(Continued)

*Primary Examiner* — Charles G Freay
(74) *Attorney, Agent, or Firm* — Crowell & Moring LLP

(57) ABSTRACT

A technique is provided that can further reduce power at the time of "unload operation control" in a gas compressor that generates a compressed gas at a set pressure by constant-speed control. The gas compressor includes a compressor main unit, a drive source, an intake throttle valve, a gas release valve, rotation speed converting means, a pressure detecting device that detects a discharge pressure, and a controller that, the relationship between an upper-limit pressure H and a lower-limit pressure L being H>L, carries out opening the intake throttle valve and closing the gas release valve and operating the drive source at a full-load rotation (Continued)

speed until the discharge pressure reaches the upper-limit pressure H. The controller carries out at least one of closing the intake throttle valve and opening the gas release valve to reduce the discharge pressure to within a predetermined range when the discharge pressure reaches the upper-limit pressure H. The controller carries out switching to load operation when the discharge pressure drops to the lower-limit pressure L. In the gas compressor, the controller outputs a command of a lower rotation speed than the full-load rotation speed to the rotation speed converting means when the discharge pressure rises and reaches the upper-limit pressure H. The controller outputs a command of the full-load rotation speed to the rotation speed converting means when the discharge pressure drops and reaches the lower-limit pressure L.

7 Claims, 10 Drawing Sheets

(51) Int. Cl.

| | |
|---|---|
| ***F04B 49/08*** | (2006.01) |
| ***F04D 27/00*** | (2006.01) |
| ***F04D 27/02*** | (2006.01) |
| ***F04C 18/16*** | (2006.01) |
| ***F04C 28/06*** | (2006.01) |
| ***F04C 28/10*** | (2006.01) |

(52) U.S. Cl.
CPC ..... *F04C 28/10* (2013.01); *F04D 27/003* (2013.01); *F04D 27/004* (2013.01); *F04D 27/009* (2013.01); *F04D 27/0223* (2013.01); *F04D 27/0253* (2013.01); *F04D 27/0261* (2013.01); *F04C 28/08* (2013.01); *F04C 2210/1005* (2013.01); *F04C 2240/403* (2013.01)

(58) Field of Classification Search
CPC ..... F04C 2210/1005; F04C 2240/403; F04D 27/004; F04D 27/009; F04D 27/003; F04D 27/0223; F04D 27/0253; F04D 27/0261
See application file for complete search history.

(56) References Cited

OTHER PUBLICATIONS

Japanese-language Written Opinion (PCT/ISA/237) issued in PCT Application No. PCT/JP2019/012697 dated Jul. 16, 2019 (five (5) pages).
English translation of document C2 (Japanese-language Written Opinion (PCT/ISA/237), filed on Sep. 29, 2020) issued in PCT Application No. PCT/JP2019/012697 dated Jul. 16, 2019 (nine (9) pages).

* cited by examiner

GAS COMPRESSOR

TECHNICAL FIELD

The present invention relates to gas compressors and relates to a gas compressor that carries out full-load operation and no-load operation (unload control operation) and controls the amount of gas discharged with respect to the amount of gas used.

BACKGROUND ART

A description will be made with use of an air compressor that takes in air and discharges high-pressure compressed air as one example of the gas compressor.

As disclosed in Patent Document 1, in an air compressor that repeats full-load operation and no-load operation and controls the maximum amount of air discharged with respect to the amount of air used, there are the following three kinds of methods as the operation method of the compressor in a rough classification.

A first method is an intake throttling control method in which a pressure adjusting valve is used to set the amount of air used the maximum amount of air discharged and the pressure adjusting valve is actuated due to a gradual rise in the discharge pressure and the amount of air taken in from the atmosphere is decreased by gradually closing an intake throttle valve. According to the control method, by controlling the amount of taken-in air through adjusting the degree of opening of the intake throttle valve, the power ratio when the ratio of the amount of air used is 0% can be reduced to approximately 65%, for example.

A second method is a purge control method. In this method, when pressure setting H (an upper-limit pressure H), pressure setting L (a lower-limit pressure L), and H>L are defined, if the discharge pressure reaches H from a pressure lower than H in full-load operation, an intake throttle valve is fully closed. In addition, the pressure in a compressor unit from the intake throttle valve to a check valve is released to the atmosphere to cause no-load operation in which the compressor power is greatly reduced. When the discharge pressure≤L is satisfied in the no-load operation, full-load operation in which release to the atmosphere is stopped and the intake throttle valve is fully opened is caused. This full-load operation and the no-load operation are repeated. According to the control method, by controlling the amount of taken-in gas through adjusting the degree of opening of the intake throttle valve, the power ratio when the ratio of the amount of air used is 0% can be reduced to approximately 65%, for example.

A third method is a method using the intake throttling method and the purge method in combination and is a method of carrying out switching of the method in which the intake throttling method is used when the amount of use of compressed air is large and the purge method is used when the amount of air used is small. When the amount of air used is small, the degree of opening of the intake throttling valve is set to full closing and the amount of taken-in gas is set to almost zero. In addition, the pressure in the compressor unit from the intake throttle valve to the check valve, i.e., the internal pressure, is released to the atmosphere to greatly lower the internal pressure. Thereby, the power can be reduced to approximately 35% of a power ratio, for example.

Besides them, a variable-speed compressor is known that controls the rotation speed of an electric motor, which drives a compressor, through an inverter and controls the discharge pressure of the compressor in such a manner that the discharge pressure is constant around a target pressure by PI or PID control. Patent Document 1 discloses a variable-speed control method. In this method, variable control of the rotation speed of the electric motor is carried out from the full speed to the lowest speed at such a degree that torque insufficiency is not caused with respect to change in the amount of air used in such a manner that the discharge pressure becomes constant. When the amount of air used further decreases, pressure raising control is carried out to the upper-limit pressure equal to or higher than the target pressure in the state in which the rotation speed of the electric motor is the lowest speed. When the pressure has risen to the upper-limit pressure, purge control is carried out in the state in which the rotation speed of the electric motor is the lowest speed. When the amount of air used further decreases, the electric motor is stopped.

According to the control method, for example, when the ratio of the amount of air used is 100% to approximately 30%, the rotation speed of the electric motor is varied from the full speed to approximately 30% while the discharge pressure is set within a certain range. Thereby, the power ratio can be reduced from 100% to approximately 30%. When the ratio of the amount of air used is 30% to approximately 0%, the pressure raising control and the purge control at the lowest speed of the electric motor are carried out and thereby the power can be reduced to approximately 10% of a power ratio.

PRIOR ART DOCUMENT

Patent Document

Patent Document 1: JP-1997-287580-A

SUMMARY OF THE INVENTION

Problem to be Solved by the Invention

Here, if the electric motor is a constant-speed type, with the above-described first three control methods, there is a limit to the power reduction even when the power reduction is intended through closing the intake throttle valve to decrease the amount of taken-in air and releasing the internal pressure to the atmosphere.

Furthermore, in the above-described variable-speed control method, a highly-functional and expensive variable-speed device that can change the rotation speed of the electric motor from the full speed to approximately 30% at high speed and smoothly and a highly-functional, and an expensive device that carries out PI or PID control for setting the discharge pressure within a certain range are necessary. Moreover, a lot of development time is necessary for optimal adjustment for optimization of the PI or PID control. In addition, it is necessary to carry out studies on reinforcement and anti-vibration structure for suppressing resonance regarding a resonance point of the compressor unit generated when the rotation speed of the electric motor is changed from the full speed to approximately 30%, and a resonance avoidance method in which a jump function of the variable-speed device is used, and so forth. Thus, the possibility that complexity of the development and cost increase are caused is high.

A gas compressor that intends more power reduction with a simpler configuration is desired.

Means for Solving the Problem

In order to achieve the above-described object, for example, the configuration set forth in the scope of claims is applied. Specifically, a gas compressor includes a compressor main unit that compresses a gas, a drive source that drives the compressor main unit, an intake throttle valve that adjusts the amount of gas intake of the compressor main unit, a gas release valve that releases a discharged gas of the compressor main unit to an atmospheric pressure environment, rotation speed converting means that changes the rotation speed of the drive source, a pressure detecting device that detects a discharge pressure of a discharged gas system, and a controller that, the relationship between an upper-limit pressure H and a lower-limit pressure L being H>L, carries out opening the intake throttle valve and closing the gas release valve and operating the drive source at a full-load rotation speed until the discharge pressure reaches the upper-limit pressure H. The controller carries out at least one of closing the intake throttle valve and opening the gas release valve to reduce the discharge pressure to within a predetermined range when the discharge pressure reaches the upper-limit pressure H. The controller carries out switching to load operation when the discharge pressure drops to the lower-limit pressure L. In the gas compressor, the controller outputs a command of a lower rotation speed than the full-load rotation speed to the rotation speed converting means when the discharge pressure rises and reaches the upper-limit pressure H. The controller outputs a command of the full-load rotation speed to the rotation speed converting means when the discharge pressure drops and reaches the lower-limit pressure L.

Advantage of the Invention

According to the present invention, a significant energy saving effect can be exerted with a simpler configuration. Other problems, configurations, and effects of the present invention will become apparent from the following description.

Modes for Carrying Out the Invention

Modes for carrying out the present invention will be described below with use of the drawings.

Embodiment 1

A description will be made with use of an air compressor 100 (hereinafter, referred to as "compressor 100" in some cases) that compresses air as an embodiment to which the present invention is applied.

Figure 1:
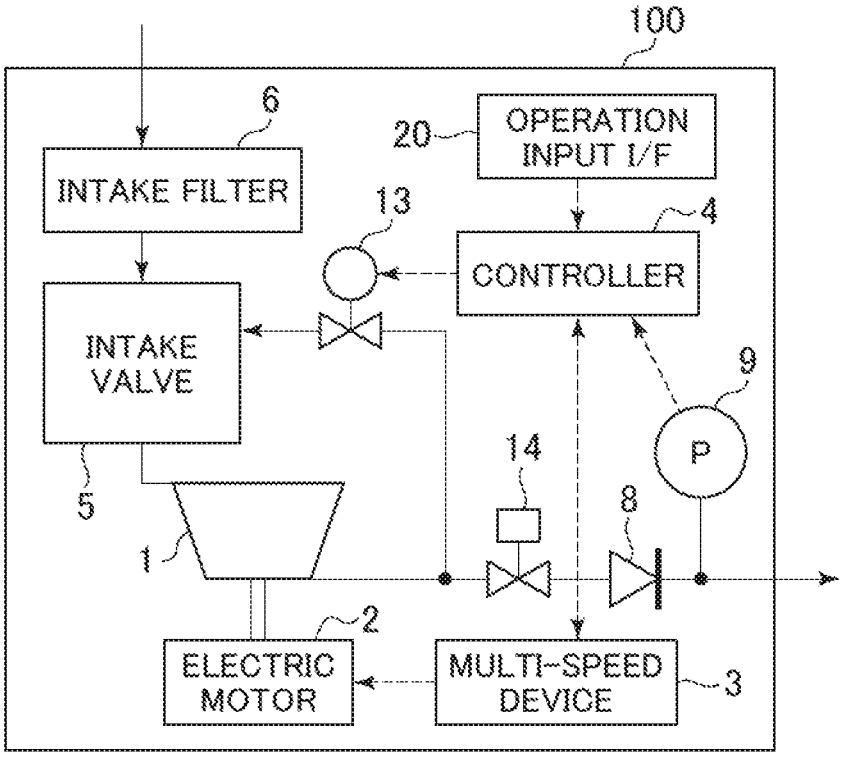
FIG. 1 is a block diagram schematically showing the configuration of an air compressor according to embodiment 1 to which the present invention is applied.
Figure 2:
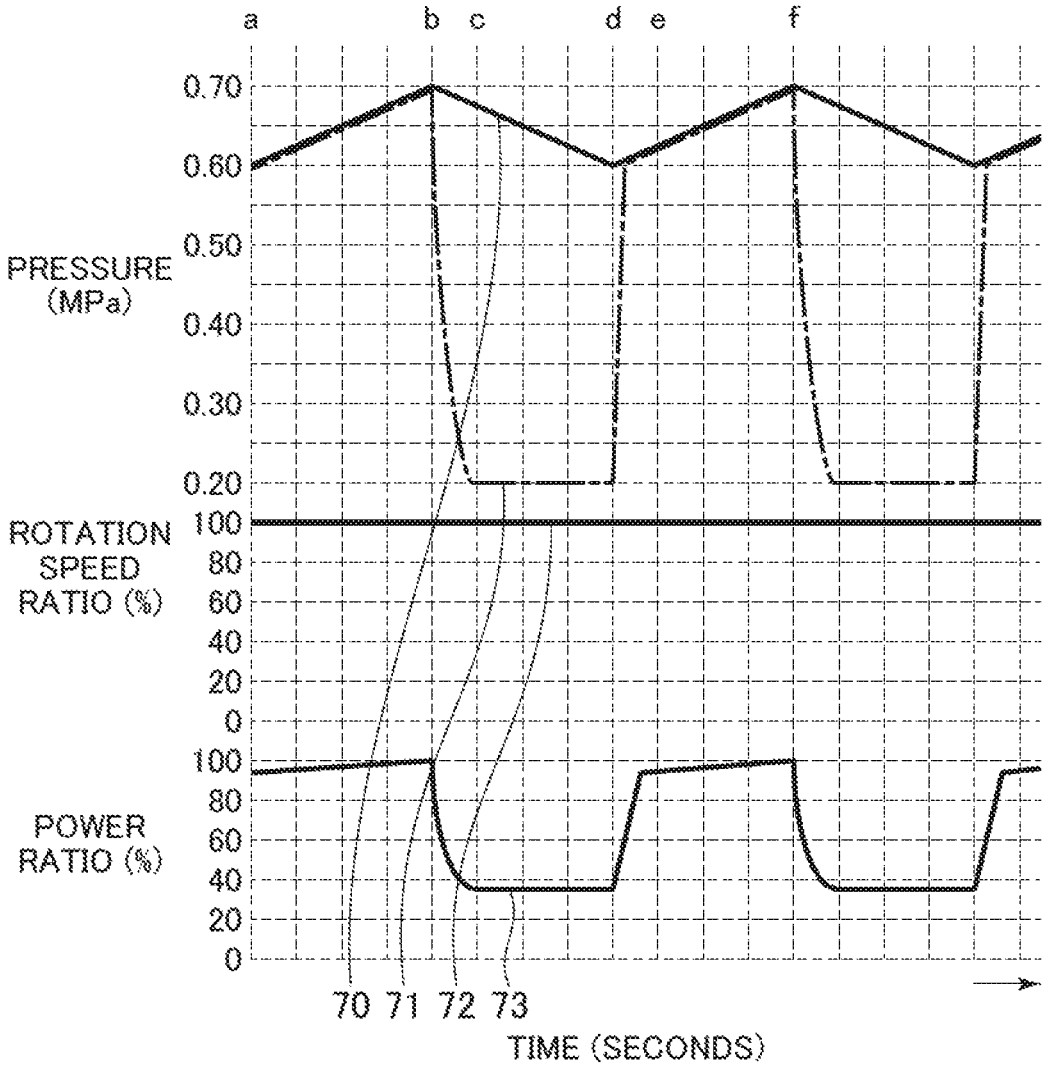
FIG. 2 is a time chart of capacity control of an air compressor according to a comparative example.
Figure 3:
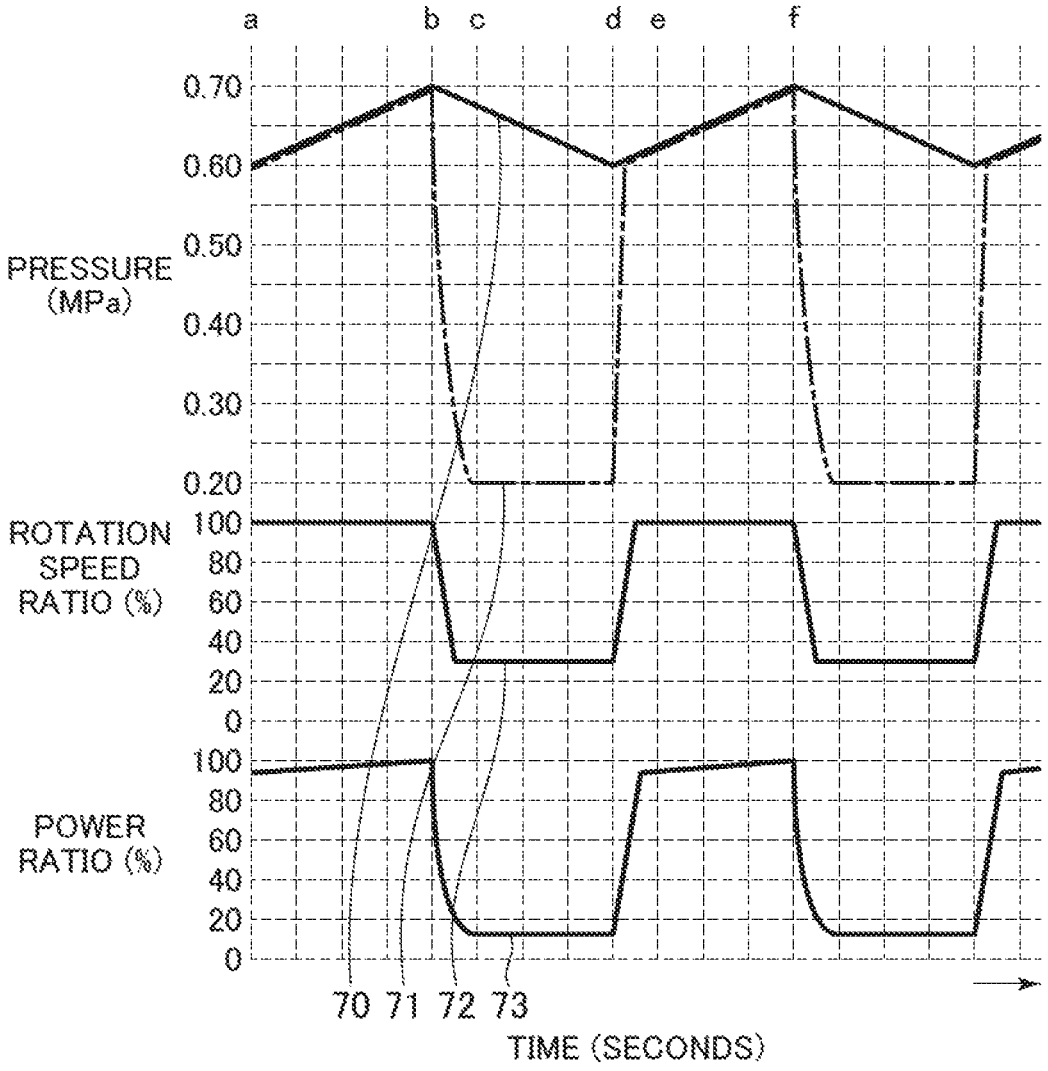
FIG. 3 is a time chart of capacity control of the air compressor according to embodiment 1.

The configuration, operation examples, and so forth of the compressor 100 according to an embodiment 1 are shown in FIG. 1 and FIG. 3. FIG. 1 is a block diagram schematically showing the configuration of the compressor 100. FIG. 2 is a time chart showing the manner of capacity control of an air compressor according to a comparative example. FIG. 3 is a time chart showing the manners of capacity control by the compressor 100 of the present embodiment.

In FIG. 1, the compressor 100 mainly includes a compressor main unit 1, an electric motor 2 (drive source) that drives it, a multi-speed device 3 (rotation speed converting means) that controls the rotation speed of the electric motor 2, and a controller 4 that outputs an operation command and a rotation speed command to the multi-speed device 3 and controls operation of the compressor main unit 1. In the present embodiment, the description will be made based on the premise that an inverter is used as the multi-speed device 3. However, the combination of the electric motor 2 and the multi-speed device 3 may be a pole change motor or gear change motor.

The compressor 100 carries out intake of air through an intake filter 6 by rotational driving of the compressor main unit 1. The taken-in air passes through an intake throttle valve 5 and is drawn and flow into a compression chamber of the compressor main unit 1 to be compressed.

The intake throttle valve 5 is a mechanical open-close valve or an electromagnetic open-close valve using a driving force of an electric motor or the like. The compressor 100 controls the amount of air taken in into the compression chamber depending on opening and closing of the intake throttle valve 5 and the degree thereof. In the present embodiment, the description will be made based on the premise that the mechanical intake throttle valve 5 is used.

The air compressed in the compression chamber is discharged out from the compressor main unit 1 into a discharge piping system and is discharged out to the external of the compressor 100 (side of the user of the compressed air) through a check valve 8. Although not shown in the diagram, the compressed air discharged out from the compressor 100 goes through air tank, air filter, and so forth and is supplied to end equipment of the piping system.

The air compressed by the compressor main unit 1 is used also as an operation pressure for the compressor 100. Specifically, the discharge piping system has a branch pipe that connects to the intake throttle valve 5 in the middle and has, on this branch pipe, a solenoid valve 13 that permits and restricts flow of the compressed air according to a control command from the controller 4. Through opening of the solenoid valve, a control pressure is supplied to the intake throttle valve 5 and the intake throttle valve 5 is closed.

Furthermore, the compressor 100 includes, in the discharge piping system, a gas release valve 14 at the downstream of the branch point of this branch pipe and at the upstream of the check valve 8. The gas release valve 14 is an electromagnetic or mechanical valve element that releases the compressed air on the upstream side of the check valve 8 to an atmospheric pressure environment and carries out opening-closing action by a control signal from the controller 4. In the present embodiment, the description will be made based on the premise that an electromagnetic valve element is applied.

On the discharge pipe, a pressure sensor 9 is disposed at the downstream of the check valve 8. The pressure detected by the pressure sensor 9 is output to the controller 4. The controller 4 implements a functional section by cooperation of a calculation circuit and a program, for example, and carries out various kinds of control of the compressor 100. Part or all of the controller 4 may be configured by an analog control circuit.

The controller 4 outputs, to the multi-speed device 3, the rotation speed command of a rotation speed corresponding to a pressure according to a set pressure input through an operation input-output I/F 20 and controls the output rotation speed of the electric motor 2. That is, the compressor 100 is a compressor of constant-speed control.

Specifically, when the set pressure input through the operation input-output I/F 20 is a pressure L (Pha), the controller 4 calculates the rotation speed corresponding to the pressure L (Pha) at predetermined intervals (optional time intervals) by calculation based on the rated full-load rotation speed and outputs the calculation result to the multi-speed device 3.

The present invention is not limited thereto. For example, rotation speed information that defines the rotation speed corresponding to the set pressure in advance may be stored in the controller 4 in advance and the rotation speed command may be output to the multi-speed device 3 based on this.

Furthermore, when the discharge pressure detected by the pressure sensor 9 has become a predetermined pressure, the controller 4 carries out "unload operation control (no-load operation control)" in order to save the driving energy. Here, the "unload operation control" is operation control in which power reduction of the compressor 100 is intended through the following three actions by the controller 4. Specifically, the controller 4 issues a command to the solenoid valve 13 and closes the solenoid valve 13 to limit the air intake amount. The controller 4 opens the gas release valve 14 to release the compressed air on the upstream side of the check valve 8 to the atmosphere. The controller 4 lowers the rotation speed of the electric motor 2 to a predetermined rotation speed by outputting a predetermined command to the multi-speed device 3.

When the electric motor 2 is lowered to the predetermined rotation speed, the command of a rotation speed lower than the rated full-load rotation speed is output from the controller 4 to the multi-speed device 3. This lower rotation speed may be a rotation speed that can provide a pressure with which the control pressure for the intake throttle valve 5 and so forth can be ensured, or may be a rotation speed that is lower than the full-load rotation speed and is higher than the rotation speed that can provide the pressure with which the control pressure can be ensured. That is, if the lower-limit rotation speed in steady operation of the compressor 100 is deemed as the rotation speed that can provide the pressure with which the control pressure can be ensured, this rotation speed may be employed as the rotation speed at the time of the "unload operation control" or a rotation speed that is higher than it and is lower than the full rotation speed may be employed. If the lower-limit rotation speed is employed, power saving of the electric motor 2 can be achieved more effectively. If a rotation speed that is higher than the lower-limit rotation speed and is lower than the full rotation speed is employed, the corresponding power saving effect and an effect that followability to the discharge pressure improves in return from the "unload operation control" to "load operation control" can be obtained.

The present invention is not limited to the above-described method in implementing the "unload operation control" and the "unload operation control" can be implemented even with a system in which only either one of closing the intake throttle valve 5 and opening the gas release valve 14 is carried out.

Furthermore, in the "unload operation control," the execution timings at which commands to close the intake throttle valve 5 and open the gas release valve 14 and lower the rotation speed of the electric motor 2 to the predetermined rotation speed are output from the controller 4 are substantially the same timing according to the processing speed and performance condition of the controller 4 (timing according to the command output performance of the controller 4). However, the present invention is not limited thereto and is not limited to execution at strictly the same timing in such a range as not to depart from the gist thereof.

Subsequently, operation control of the compressor 100 will be described.

In FIG. 3, the relationship among the pressure of discharge by operation of the compressor 100, the rotation speed ratio of the compressor, and the power ratio is shown in a time-series manner. A discharge pressure 70 is the secondary-side pressure of the check valve 8 and is the pressure detected by the pressure sensor 9. An internal pressure 71 is the primary-side pressure of the check valve 8 and is the secondary-side pressure of the compressor main unit 1. A compressor rotation speed ratio 72 is the rotation speed ratio of the compressor main unit 1. A power ratio 73 is the power ratio of the multi-speed device 3 for driving the electric motor 2 that rotates the compressor main unit 1. The ordinate axes indicate the pressure (MPa), the rotation speed ratio (%), and the power ratio (%), respectively, and the abscissa axis indicates the time (seconds).

The description will be made by taking, as an example of the compressor 100 of the present embodiment, a compressor in which the specification pressure is 0.7 MPa and the power ratio becomes 100% when the discharge pressure is 0.7 MPa and the rotation speed ratio and the ratio of the amount of air discharged about the compressor main unit 1 are 100%. Furthermore, suppose that, in this diagram, the amount of air when the ratio of the amount of air discharged is 100% and the amount of air when the ratio of the amount of air used is 100% are the same and the ratio of the amount of air used is 50%. In addition, suppose that the relationship between pressure setting H (0.7 MPa) and pressure setting L (0.6 MPa) included in the controller 4 is H>L. Furthermore, suppose that, in full-load operation, the intake throttle valve 5 is opened and the gas release valve 14 is closed and the electric motor 2 is operated with the full-load rotation speed and, when the discharge pressure 70 has reached the pressure setting H, switching is carried out to the "unload control operation" in which the intake throttle valve 5 is closed and the gas release valve 14 is opened and the discharge pressure is reduced to within a predetermined range with a fixed rotation speed resulting from the lowering of the rotation speed of the electric motor 2 to the predetermined rotation speed. Moreover, suppose that, when the discharge pressure 70 has dropped from the pressure setting H to the pressure setting L, the intake throttle valve 5 is opened and the gas release valve 14 is closed and the rotation speed of the electric motor 2 is switched to the full-load rotation speed.

At a time a, the discharge pressure 70 and the internal pressure 71 are 0.6 MPa and the compressor rotation speed ratio is 100%. The discharge pressure is 0.6 MPa against the specification pressure 0.7 MPa and thus the pressure is lower by 0.1 MPa. Therefore, the power ratio 73 is approximately 93% lower than 100%.

In the period from the time a to a time b, the ratio of the amount of air discharged is 100% whereas the ratio of the amount of air used is 50%. Therefore, the discharge pressure 70 and the internal pressure 71 rise from 0.6 to 0.7 MPa, and the power ratio rises from 93% to 100% because the discharge pressure rises although the rotation speed ratio remains 100%.

At the time b, when the pressure detected by the controller 4 by the pressure sensor 9, i.e. the discharge pressure 70, becomes the pressure H (0.7 MPa), the controller 4 closes the intake throttle valve 5 and opens the gas release valve 14. Moreover, the controller 4 outputs, to the multi-speed device 3, a command to set the compressor rotation speed to a fixed rotation speed lower than the rotation speed based on the full-load rotation speed to carry out switching to the "unload control operation."

In the period from the time b to c, the taken-in air of the compressor main unit 1 becomes absent and the amount of air discharged from the compressor main unit 1 is also absent because the intake throttle valve 5 is closed, and the ratio of the amount of air used remains 50%. Therefore, the discharge pressure 70 gradually lowers from 0.7 MPa. In addition, because the air release to the atmosphere is also carried out, the internal pressure 71 lowers from 0.7 MPa and converges on 0.2 MPa. Furthermore, the controller 4 outputs a low-speed command to the multi-speed device 3 and outputs a command to set the rotation speed of the electric motor 2 to the predetermined fixed low-speed rotation, so that the compressor rotation speed ratio 72 becomes 30%. At this time, the internal pressure 71 lowers and the compressor rotation speed ratio 72 lowers. Due to this, the power ratio 73 decreases from 100% to approximately 13%.

In the period from the time c to d, the internal pressure 71 is 0.2 MPa and the compressor rotation speed ratio 72 is 30% and the power ratio 73 is in the state of approximately 13%. Because the ratio of the amount of air discharged is zero and the ratio of the amount of air used is 50%, the discharge pressure 70 gradually lowers to become 0.6 MPa.

At the time d, when the pressure detected by the controller 4 by the pressure sensor 9, i.e. the discharge pressure 70, becomes 0.6 MPa, the controller 4 opens the intake throttle valve 5 and closes the gas release valve 14 and outputs a command to set the compressor rotation speed to the full-load rotation speed.

In the period from the time d to e, the intake throttle valve is opened and the gas release valve 14 is closed and the internal pressure 71 starts a pressure rise from 0.2 MPa. Furthermore, the controller 4 outputs a command of the full-load rotation speed to the multi-speed device to set the rotation speed of the electric motor 2 to the full-load rotation speed. Thus, the internal pressure becomes 0.6 MPa and the compressor rotation speed ratio 72 becomes 100% from 30%. At this time, due to the rise in the compressor rotation speed ratio 72, the power ratio 73 rises to approximately 93%.

In the period from the time e to f, the compressor rotation speed ratio 72 is in the state of 100%. The discharge pressure 70 gradually rises to become 0.7 MPa because the ratio of the amount of air discharged is 100% and the ratio of the amount of air used is 50%, and the power ratio 73 rises to 100%. At the time f and the subsequent times, the same operation as that at the time b and the subsequent times is repeated.

As a comparative example, the pressure, the rotation speed ratio, and the power ratio in the case in which the rotation speed of the electric motor 2 is fixed at the full-load rotation speed in the "unload control operation" are shown in FIG. 2. In this diagram, from the time b to c, only the intake throttle valve 5 is closed and the gas release valve 14 is opened and the compressor rotation speed ratio 72 remains in the state of 100%. Thus, the power ratio 73 lowers to only approximately 35%.

The computation method of an approximate ratio of the amount of air used at the time of an optional amount of air used, i.e. the load factor, and the power is as follows. Regarding a full-load operation time df, a no-load operation time bd, and this one cycle time (df+bd), df/(df+bd)×100 is a calculated load factor (%). The power at the time of the calculated load factor when the value obtained by adding the power of full-load operation when the discharge pressure is 0.7 MPa and the power of full-load operation when the discharge pressure is 0.6 MPa and dividing the sum by 2 is deemed as the average power at the time of full-load operation is {the calculated load factor×the average power at the time of full-load operation+(100−the calculated load factor)×power at the time of no-load operation}.

As long as the amount of air used is not 100% and not larger than 100%, inevitably the full-load operation and the unload control operation are alternately repeated. When the amount of air used is larger, the ratio of the full-load operation is higher, so that the power remains high. However, as the amount of air used lowers, the ratio of the time of no-load operation with respect to one cycle increases. Therefore, the average power can be lowered by setting the compressor rotation speed to a low speed at the time of no-load operation.

As above, in the present embodiment, in the compressor that carries out operation in such a manner that the rotation speed of the electric motor 2 is set to a constant-speed (fixed) rotation speed in full-load operation, significant energy saving can be intended by reducing the rotation speed of the compressor at the time of unload operation.

Embodiment 2

An embodiment 2 of the compressor 100 to which the present invention is applied will be described. In the following, although the embodiment 2 will be described with use of a drawing, the same character is used regarding the same element as the embodiment 1 and detailed description thereof is omitted in some cases. In the embodiment 1, the "unload control operation" is carried out with the trigger for it being that the discharge pressure of the compressor 100 has become the pressure H (0.7 MPa). In the embodiment 2, one of characteristics is that the power of the compressor 100 that carries out operation with setting to the constant-speed (fixed) rotation speed in full-load operation is further reduced by changing the pressure H that is the trigger for execution of the "unload control operation" according to the load factor of the compressor 100.

In the following, although the embodiment 2 will be described with use of the drawing, the same character is used regarding the same element as the embodiment 1 and detailed description thereof is omitted in some cases.

Figure 4:
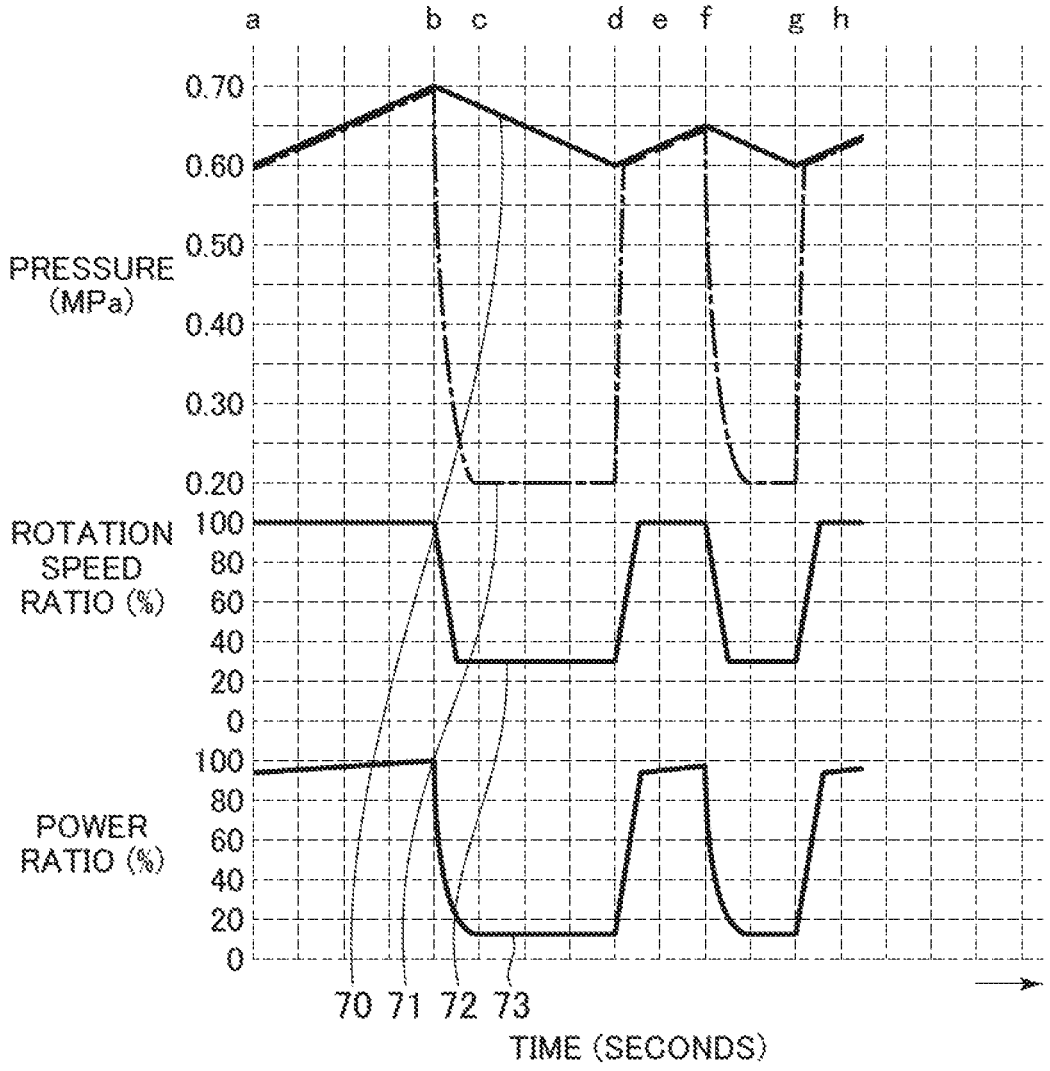
FIG. 4 is a time chart of capacity control of the air compressor according to embodiment 2.

In FIG. 4, the relationship among the pressure of discharge of the compressor 100 according to the embodiment 2, the rotation speed ratio of the compressor, and the power ratio is shown in a time-series manner.

In the time b to d, the manner in which the same "unload control operation" as the embodiment 1 is carried out is shown. In contrast, at the time d, the controller 4 changes the pressure H that is the trigger for execution of the "unload control operation" from 0.7 MPa employed thus far to 0.65 MPa. Thus, the "unload control operation" after the time d is carried out with the trigger for it being that the discharge pressure has become 0.65 MPa. Specifically, the time from exceeding of the discharge pressure over 0.6 MPa to returning to 0.6 MPa again is defined as one cycle and the pressure H in the next "unload control operation" is figured out according to the load factor in the cycle (ratio between the times ab and bd), so that the "unload control operation" is carried out.

Specifically, the controller 4 calculates (ab+bd)/T2=2 at the time d and calculates the pressure setting H of the next "unload control operation"=pressure setting L+(upper-limit pressure setting−pressure setting L)/2. Then, the controller 4 stores, as the calculation result, 0.6+(0.7−0.6)/2=0.65 MPa as the pressure setting H.

When the discharge pressure becomes 0.65 at the time f, the controller 4 carries out the "unload control operation." Furthermore, when the pressure drops again to 0.6 after the time f (time g), the controller 4 figures out the load factor in the above-described previous cycle (time dg) and, after the time g, figures out the new pressure H that is the trigger for the next "unload control operation" and carries out the "unload control operation."

As above, in the embodiment 2, in the compressor 100 that operates with constant-speed control, further energy saving in consideration of the tendency of use of air on the user side of the compressed air in addition to the effects of the embodiment 1 can be intended at the time of the "unload control operation."

Embodiment 3

An embodiment 3 of the present invention will be described with use of a drawing. The same character is used regarding the same configuration as the embodiments 1 and 2 and detailed description thereof is omitted in some cases. One of characteristics of the embodiment 3 is that, in the case of a return to full-load operation from the "unload control operation," before the pressure L is detected as the discharge pressure (detected value of the pressure sensor 9), the tendency of drop of the discharge pressure in the "unload operation" is considered and switching to the full-load operation is carried out before the discharge pressure reaches the pressure L.

Figure 5:
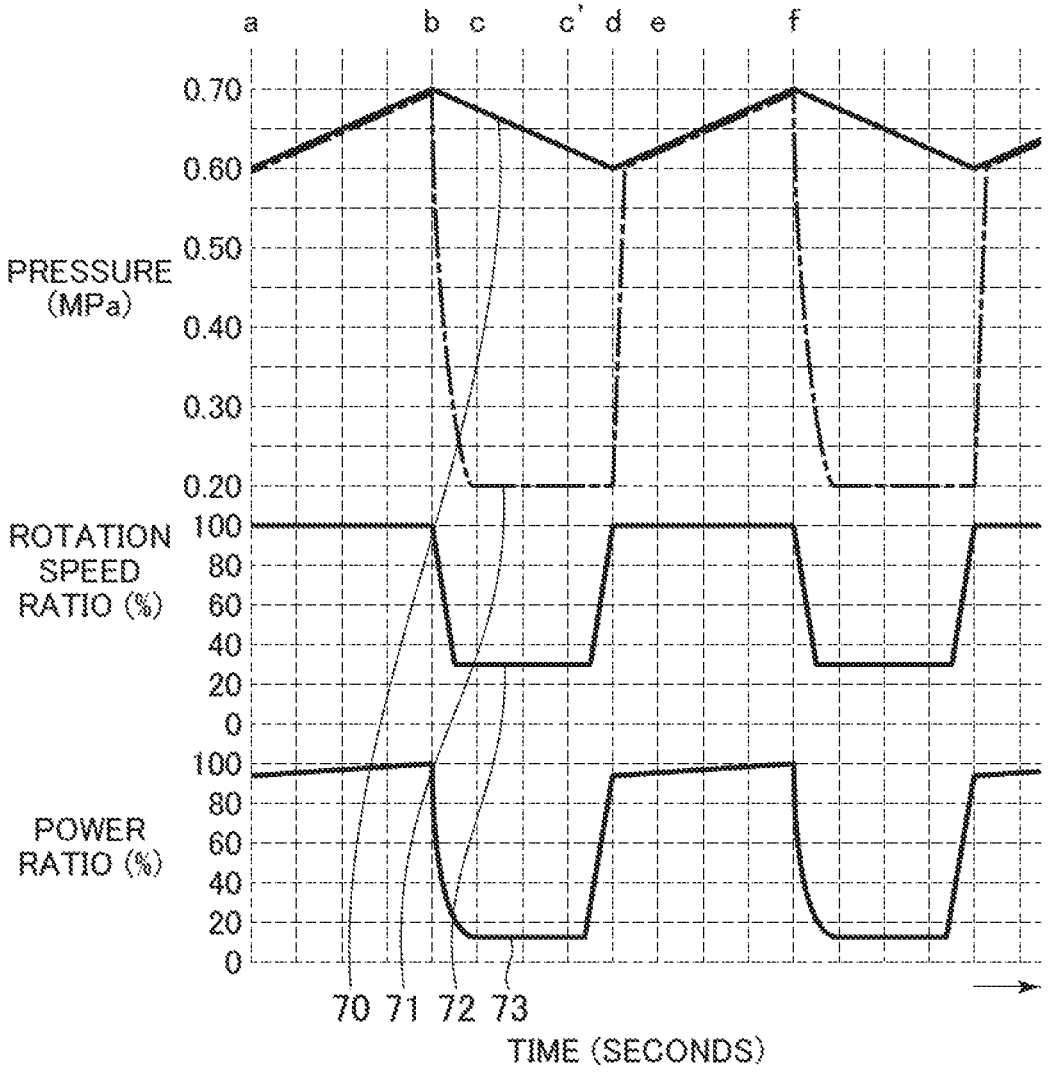
FIG. 5 is a time chart of capacity control of the air compressor according to embodiment 3.

In FIG. 5, a time chart of capacity control by the air compressor of the embodiment 3 is shown. In FIG. 5, (ab+bd)/T2=1 is assumed here. In the period from the time c to c', the internal pressure 71 is 0.2 MPa and the compressor rotation speed ratio 72 is 30% and the power ratio 73 is in the state of approximately 13%. Because the ratio of the amount of air discharged is zero and the ratio of the amount of air used is 50%, the discharge pressure 70 gradually lowers to head for 0.6 MPa.

The controller 4 has a function of calculating the lowering value of the discharge pressure per unit time detected by the pressure sensor 9. Furthermore, in this embodiment, the acceleration time necessary to accelerate the compressor rotation speed ratio 72 from 30% to 100% is defined as T1 (seconds).

In the period from the time c' to d, the discharge pressure 70 gradually lowers and is heading for 0.6 MPa. At the timing when the relationship between a pressure value P1 (MPa) of the discharge pressure 70 and a pressure lowering amount ΔP (MPa/seconds) has become {P1≤0.60+ΔP×T1} regarding the above-described acceleration time T1, the controller 4 switches the rotation speed command to the multi-speed device 3 from low-speed rotation to full-speed rotation. Thereby, the compressor rotation speed ratio starts to accelerate from 30% toward 100%. In addition to this, the power ratio 73 increases from approximately 13% toward 93%. That is, when the time until the discharge pressure reaches 0.6 MPa falls within a range that approximates the acceleration time T1, the electric motor 2 starts operation at the full rotation speed.

At the time d, the discharge pressure 70 lowers to 0.6 MPa. Almost simultaneously with this, the compressor rotation speed ratio 72 ends the acceleration to 100% and the power ratio 73 becomes 93%.

In the period from the time d to f, the intake throttle valve is opened and air release to the atmosphere is also stopped. Therefore, the internal pressure 71 instantaneously rises from 0.2 MPa to 0.6 MPa. The compressor rotation speed ratio 72 is in the state of approximately 100%. Because the ratio of the amount of air discharged is 100% and the ratio of the amount of air used is 50%, thereafter the discharge pressure 70 gradually rises to become 0.7 MPa, and the power ratio 73 rises to 100%.

In the case of the embodiment 1, when the amount of air used is comparatively large, for example if the lowering amount of the discharge pressure 70 exceeds the above-described acceleration time in the period from the time c' to d, there is a possibility that the discharge pressure 70 falls below 0.6 MPa at the time d. However, in the case of the present embodiment, the compressor rotation speed ratio has already ended the acceleration and become 100% at the time d and therefore the situation in which the discharge pressure 70 falls below 0.6 MPa does not occur.

It is also possible to apply the change processing of the pressure H according to the load factor in the embodiment 2 in addition to the control of the embodiment 3.

As above, according to the compressor 100 based on the embodiment 3, in the compressor 100 that operates with constant-speed control, the effects of the embodiment 1 can be obtained at the time of the "unload control operation." In addition, it is possible to obtain an effect that, in switching from the "unload control operation" to the full-load operation, compressed air with a predetermined pressure or higher can be generated in consideration of the power characteristic of the compressor 100 (difference in the time until the electric motor 2 and so forth enter full-load operation). Furthermore, it is also possible to apply the change processing of the pressure H according to the load factor in the embodiment 2 in addition to the control of the embodiment 3.

The embodiment 3 can be applied to not only the unload control operation in the compressor of constant-speed control but also unload operation in variable-speed control. For example, in the case of the compressor of variable-speed control, the rotation speed of a drive source (for example electric motor) is set to the lowest rotation speed or the like in the unload operation to intend reduction in the power. If, also in the case of a return to P, PI, or PID control from the lowest rotation speed at the time of return to load operation, the rotation speed of the drive source is increased before the discharge pressure reaches the lower-limit pressure in consideration of the tendency of pressure drop to the lower-limit pressure that is the return pressure, obtaining the same effects as the embodiment 3 can be expected.

Embodiment 4

Subsequently, an embodiment 4 to which the present invention is applied will be described with use of drawings.

The same character is used regarding the same configuration as the embodiments 1 to 3 and detailed description thereof is omitted in some cases. One of characteristics of the embodiment 4 is that the "unload control operation" is carried out based on not only the detected pressure by the pressure sensor 9 but the pressure of end equipment that uses compressed air generated by the compressor 100 (hereinafter, referred to as "end pressure" in some cases) as the pressure H that is the trigger for execution of the "unload control operation."

Figure 6:
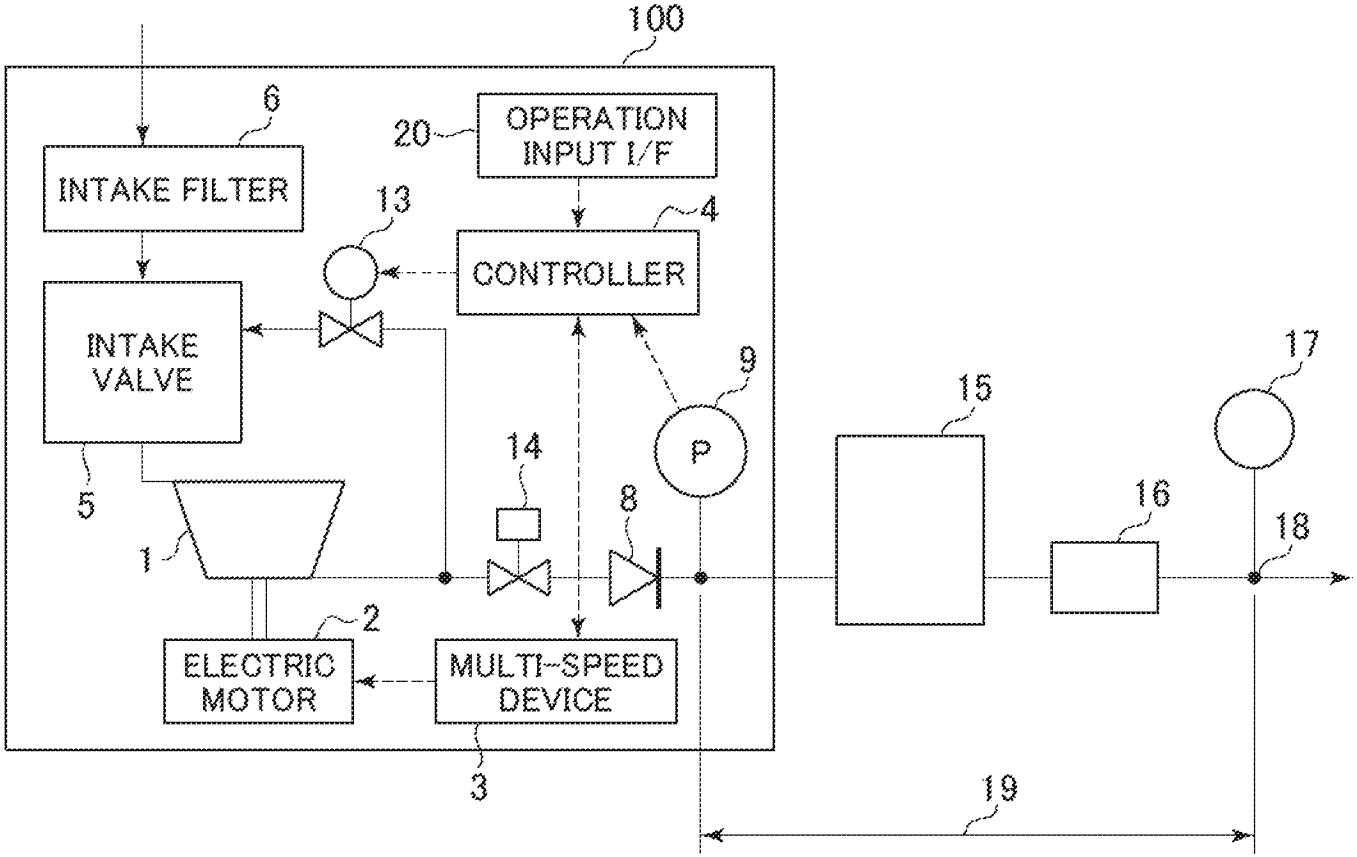
FIG. 6 is a block diagram schematically showing the configuration of an air compressor according to embodiment 4 to which the present invention is applied.
Figure 7:
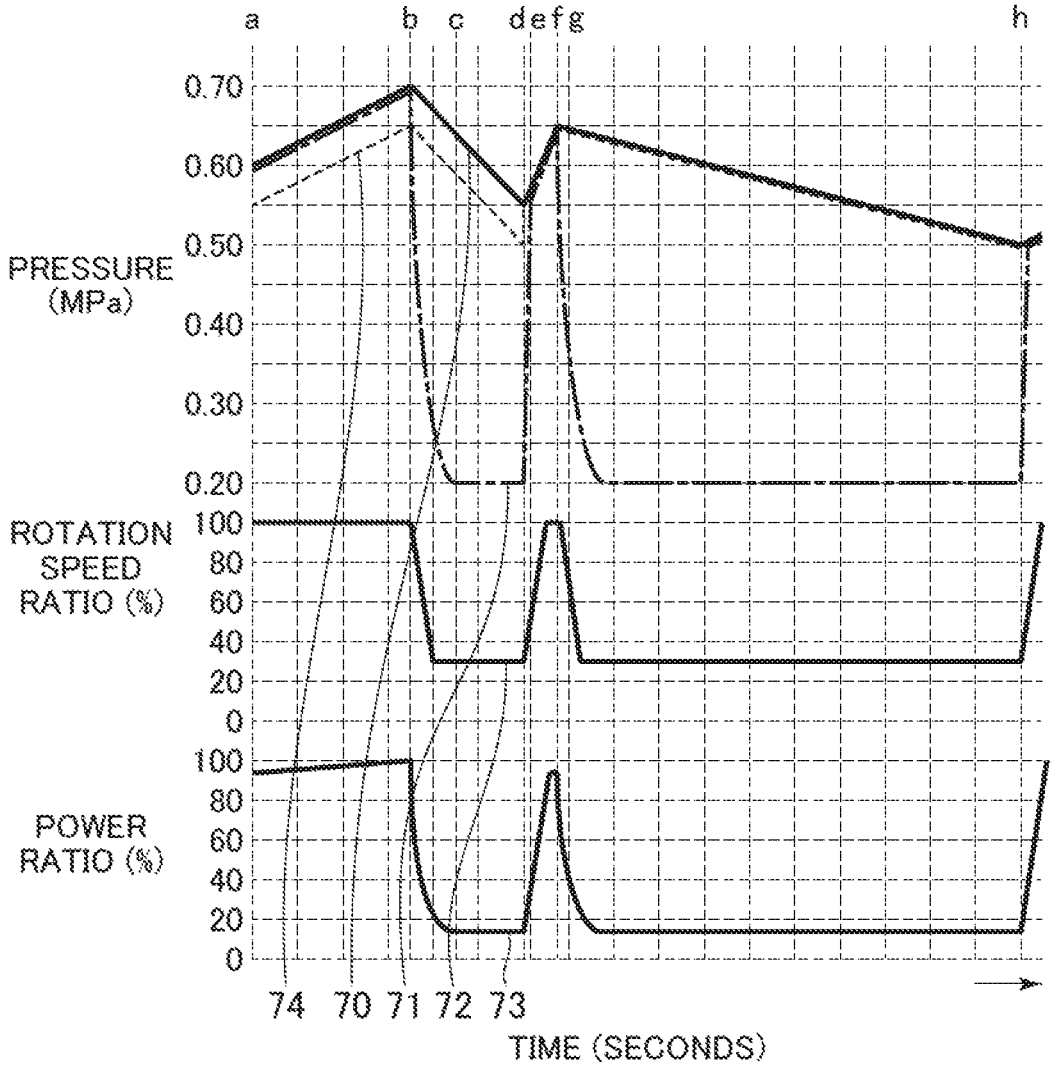
FIG. 7 is a time chart of capacity control of the air compressor according to embodiment 4.

FIG. 6 is a block diagram schematically showing the configuration of an air compressor according to the embodiment 4. FIG. 7 is a time chart of capacity control of the air compressor of the embodiment 4.

First, the configuration will be described. In FIG. 6, the compressor 100 is the same as the embodiments 1 and 2 (FIG. 1). In the embodiment 4, the compressor 100 is equipped with an air tank (gas tank) 15 that is a pressure container that stores compressed air discharged out from the compressor 100, an air filter 16 disposed on a downstream pipe thereof, and an end pressure sensor 17 that detects the pressure of the downstream side thereof. The end pressure sensor 17 is connected to the controller 4 in a wired or wireless manner and the detected pressure thereof is output to the controller 4 at predetermined time intervals. 18 denotes the end of the piping system and 19 denotes a pressure loss ΔP generated in the end-side piping system in which the compressed air discharged out from a compressor 100 circulates.

With respect to the discharge pressure 70 at the detection position of the pressure sensor 9, the pressure at the end 18 of the piping system on the consumption side of the compressed air, i.e. the pressure at the end pressure sensor 17 of the piping system, lowers by ΔP of the pressure loss 19 through the end piping system, the air tank 15, and the air filter 16. However, in the present embodiment, the description will be made based on the premise that the difference between the pressure at the detection position of the pressure sensor 9 and the pressure of the air tank 15, i.e. the pressure loss, is 0.

When the overall pipe capacity of the piping system of discharged air does not change, the pressure lowering value of the discharge pressure 70 per unit time at the time of "unload control operation" and the ratio of the amount of air used are in a proportional relationship. When the pressure lowering value becomes twice, the ratio of the amount of air used also becomes almost twice. Furthermore, there is a quadratic relationship between the ratio of the amount of air used and the pressure loss ΔP. Assuming that ΔP when the ratio of the amount of air used is 100% is 0.1 MPa, ΔP when the ratio of the amount of air used is 50% becomes 0.025 MPa, which is approximately ¼. The controller 4 has a function of setting and storing the relationship between the pressure lowering value and the ratio of the amount of air used and the relationship between the ratio of the amount of air used and the pressure loss ΔP.

Suppose that the pressure setting H in this embodiment is 0.7 MPa and the pressure setting L is 0.6 MPa and the pressure loss ΔP when the ratio of the amount of air used is 100% and the discharge pressure is 0.7 MPa is 0.1 MPa.

The transition of capacity control with such a configuration is shown in FIG. 7. Suppose that the ratio of the amount of air used is approximately 70% in the period from the time a to d and is approximately 10% in the period from the time d to h. Furthermore, suppose that here (ab+bd)/T2=(df+fh)/T2=1.

In the period from the time b to d, the controller 4 calculates the ratio of the amount of air used as 70% from the pressure lowering value and calculates ΔP as 0.05 MPa. As a result, the controller 4 continues the "unload control operation" until 0.55 MPa of pressure setting L' regarding which ΔP with respect to the maximum pressure loss 0.1 MPa when the ratio of the amount of air used is 100% is 0.05 MPa regarding the pressure setting L of the discharge pressure 70, i.e. 0.6 MPa, that is, 0.6−(0.1−0.05) MPa.

At the time d, the discharge pressure 70 is 0.55 MPa and the pressure loss ΔP is 0.05 MPa and the pressure of the end, i.e. an end pressure 74 of the end 18 of the piping system, is 0.5 MPa. At this time, when the pressure detected by the controller 4 by the pressure sensor 9, i.e. the discharge pressure 70, becomes 0.55 MPa, the controller 4 opens the intake throttle valve 5 and closes the gas release valve 14 and outputs a command to set the rotation speed of the electric motor 2 to the full rotation speed.

In the period from the time d to f, the discharge pressure 70 gradually rises from 0.55 MPa in full-load operation. At the time f, switching to the "unload control operation" is carried out when the discharge pressure 70 reaches 0.65 MPa of pressure setting H'.

In the period from the time f to h, the controller 4 calculates the ratio of the amount of air used as 10% from the pressure lowering value and calculates ΔP as 0.001 MPa. As a result, the controller 4 continues the "unload control operation" until 0.501 MPa of the pressure setting L' regarding which ΔP with respect to the maximum pressure loss 0.1 MPa when the ratio of the amount of air used is 100% is 0.001 MPa regarding the pressure setting L of the discharge pressure 70, i.e. 0.6 MPa, that is, 0.6−(0.1−0.001) MPa.

At the time h, the discharge pressure 70 is 0.501 MPa and the pressure loss ΔP is 0.001 MPa and the pressure of the end, i.e. the end pressure 74 of the end 18 of the piping system, is 0.5 MPa. At this time, when the pressure detected by the controller 4 by the pressure sensor 9, i.e. the discharge pressure 70, becomes 0.501 MPa, the controller 4 opens the intake throttle valve 5 and closes the gas release valve 14 and outputs a command to set the rotation speed of the electric motor 2 to the full-speed operation.

As above, according to the present embodiment, in the compressor 100 of constant-speed control, the end pressure can be held within a certain range in consideration of the pressure loss ΔP and power saving can be intended.

Embodiment 5

An embodiment 5 to which the present invention is applied will be described with use of a drawing. The same character is used regarding the same configuration as the above-described other embodiments and detailed description thereof is omitted in some cases.

Figure 8:
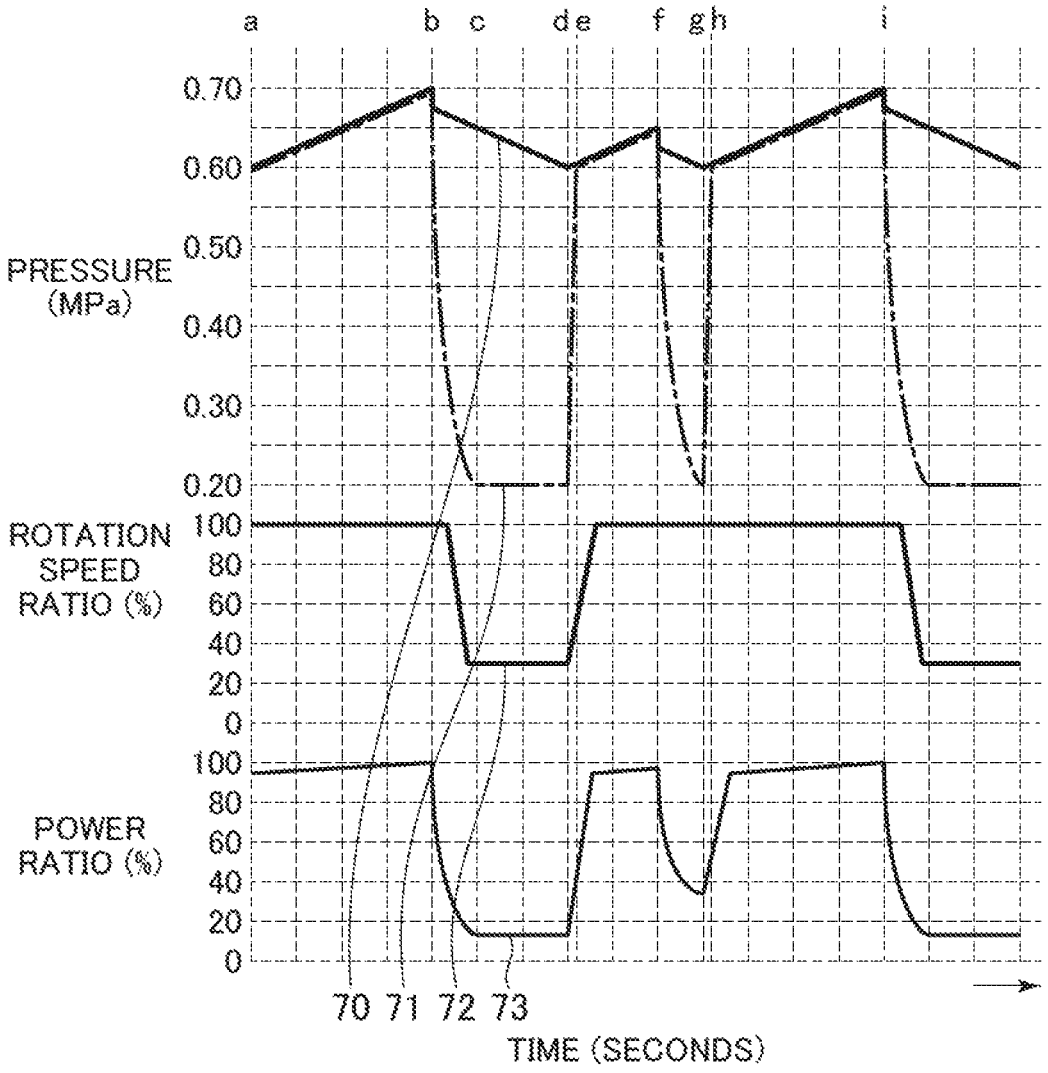
FIG. 8 is a time chart of capacity control of the air compressor of embodiment 5.

FIG. 8 is a time chart of capacity control of an air compressor of the embodiment. Suppose that here (ab+bd)/T2=2. Suppose that the difference between the pressure at the detection position of the pressure sensor 9 and the pressure of the air tank 15, i.e. the pressure loss, is 0.025 MPa in full-load operation and is 0 in no-load operation.

At the time b, when the pressure detected by the controller 4 by the pressure sensor 9, i.e. the discharge pressure 70, becomes 0.7 MPa, the controller 4 closes the intake throttle valve 5 and opens the gas release valve 14. At this time, the discharge pressure 70 lowers by the pressure loss 0.025 MPa in the above-described full-load operation and therefore lowers to 0.675 MPa. After this lowering by the pressure loss has ended, the controller 4 outputs a command to set the rotation speed of the electric motor 2 to low-speed rotation. That is, the controller 4 carries out the "unload control operation." Furthermore, the pressure drop by the pressure loss may be determined through detecting the lowering of the discharge pressure or may be determined with the elapse of a value arising from storing of predetermined time setting.

At the time d, when the pressure detected by the controller 4 by the pressure sensor 9, i.e. the discharge pressure 70, becomes 0.6 MPa, the controller 4 opens the intake throttle valve 5 and closes the gas release valve 14 and outputs a command to set the rotation speed of the electric motor 2 to full-speed rotation. At this time, because (ab+bd)/T2=2, the controller 4 calculates pressure setting H=pressure setting L+(upper-limit pressure setting−pressure setting L)/2 and employs 0.6+(0.7−0.6)/2=0.65 MPa as the calculation result for the pressure setting H.

At the time f, the discharge pressure 70 reaches the pressure setting H=0.65 MPa and therefore switching to no-load operation is carried out. At this time, the discharge pressure 70 lowers by the pressure loss 0.025 MPa in the above-described full-load operation and therefore lowers to 0.625 MPa. The discharge pressure 70 is 0.625 MPa against 0.6 MPa of the pressure setting L and thus the pressure difference is only 0.025 MPa. Because this pressure difference is smaller than 0.03 MPa that is predetermined pressure difference setting, the controller 4 stops urging the compressor rotation speed toward low-speed rotation and keeps high-speed rotation. This pressure difference setting can be set and stored.

As above, if the discharge pressure 70 becomes close to the pressure setting L due to pressure lowering by the pressure loss at the time of switching from the full-load operation to the "unload control operation," the discharge pressure 70 reaches the pressure setting L before the compressor rotation reaches low-speed rotation although the compressor rotation speed is urged toward the low-speed rotation. Therefore, it becomes impossible to exert the effect of power reduction by setting the compressor rotation speed to the low speed. In such a case, by keeping the compressor rotation speed at high-speed rotation, the pressure setting H of the next time is set higher and power reduction by setting the compressor rotation speed to low-speed rotation at the time of next no-load operation is prioritized over power reduction by pressure reduction. Thereby, the power reduction effect is improved as a whole. The controller 4 has this function.

Furthermore, at this time, the pressure setting H of the next time is returned to 0.7 MPa, which is the upper-limit pressure setting, with ignorance of the above expression. The controller 4 has this function.

At the time g, when the pressure detected by the controller 4 by the pressure sensor 9, i.e. the discharge pressure 70, becomes 0.6 MPa, the controller 4 outputs a command of ON to the solenoid valve 13 and excites it to open the intake throttle valve 5. In addition to this, the controller 4 stops the air release to the atmosphere from the internal pressure from the compressor main unit 1 to the check valve 8. That is, full-load operation is set. The compressor rotation speed is kept at high-speed rotation and the pressure setting H is returned to 0.7 MPa.

At a time i, when the pressure detected by the controller 4 by the pressure sensor 9, i.e. the discharge pressure 70, becomes 0.7 MPa, the controller 4 sets no-load operation and urges the compressor rotation speed toward low-speed rotation after the discharge pressure 70 lowers to 0.675 MPa.

As above, operation is carried out in consideration of the power reduction effect by each of the switching of no-load operation, the switching of the pressure setting H, and the switching of the compressor rotation speed. Therefore, the overall power reduction effect of the operation can be exerted to the maximum.

Embodiment 6

An embodiment 6 to which the present invention is applied will be described with use of a drawing. The same character is used regarding the same configuration as the above-described other embodiments and detailed description thereof is omitted in some cases.

Figure 9:
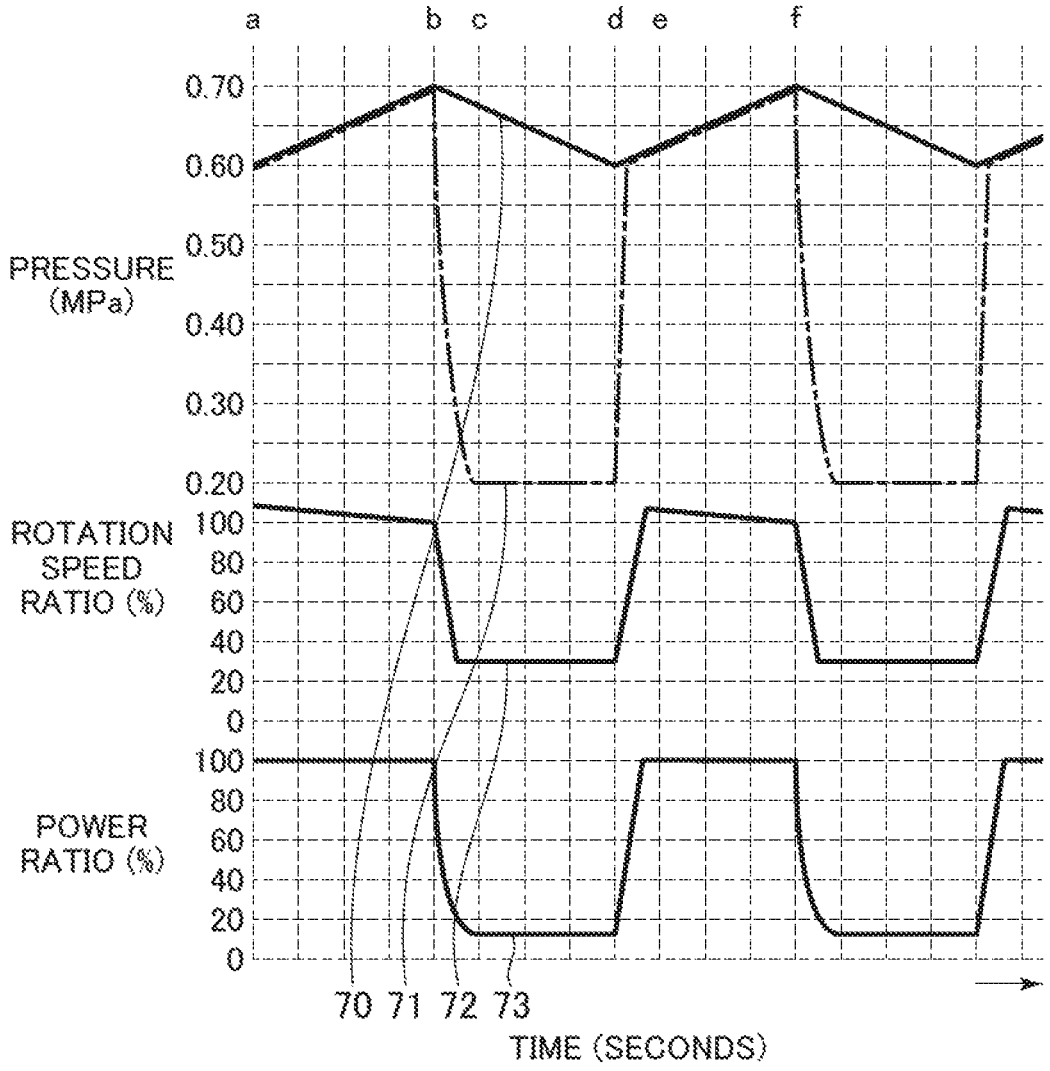
FIG. 9 is a time chart of capacity control of the air compressor of embodiment 6.

FIG. 9 is a time chart of capacity control of an air compressor according to the embodiment 6.

The controller 4 of the present embodiment has a function of varying the compressor rotation speed ratio 72 in a proportional relationship between the pressure setting H and the pressure setting L in such a manner that the compressor rotation speed ratio 72 is 100% when the discharge pressure 70 detected by the pressure sensor 9 is the pressure setting H, i.e. 0.7 MPa, and is 107% when the discharge pressure 70 is the pressure setting L, i.e. 0.6 MPa.

In FIG. 9, suppose that here (ab+bd)/T2=1. In the period from the time d to e, the intake throttle valve is opened and air release to the atmosphere is also stopped. Therefore, the internal pressure 71 instantaneously rises from 0.2 MPa to 0.6 MPa. In addition to this, the controller 4 outputs a high-speed command to the multi-speed device and urges the rotation speed of the electric motor 2 and the compressor main unit 1 toward high-speed rotation. Because the discharge pressure 70 is 0.6 MPa, the compressor rotation speed ratio 72 becomes 107% from 30%. At this time, due to the rise in the compressor rotation speed ratio 72, the power ratio 73 rises to 100%.

In the period from the time e to f, the compressor rotation speed ratio 72 lowers from 107% to 100% in proportion to the rise in the discharge pressure 70 from 0.6 MPa to 0.7 MPa. The power ratio 73 keeps almost 100% from the relationship between the discharge pressure 70 and the compressor rotation speed ratio 72.

The relationship between the discharge pressure 70 and the compressor rotation speed ratio 72 does not have to be proportional, i.e. linear expression, and may be a quadratic expression or the like and may be any as long as it is a relationship with which the power ratio 73 is almost constant. Furthermore, the compressor rotation speed ratio when the discharge pressure 70 is 0.7 MPa is 100% whereas the compressor rotation speed ratio when the discharge pressure 70 is 0.6 MPa is 107% and exceeds 100%. However, this is a relative expression and even 107% does not mean overload.

As above, according to the present embodiment, in the compressor 100 that operates with constant-speed control, significant energy saving can be intended by reducing the rotation speed of the compressor at the time of "unload control operation." In addition, by increasing the amount of air discharged when the discharge pressure 70 is low and decreasing the amount of air discharged when the discharge pressure 70 is high, suppression of pressure lowering can be intended even in the case in which the amount of air used increases when the discharge pressure 70 is low, without overloading of the compressor 100.

Embodiment 7

The embodiment 7 to which the present invention is applied will be described with use of a drawing. The same character is used regarding the same configuration as the above-described other embodiments and detailed description thereof is omitted in some cases.

Figure 10:
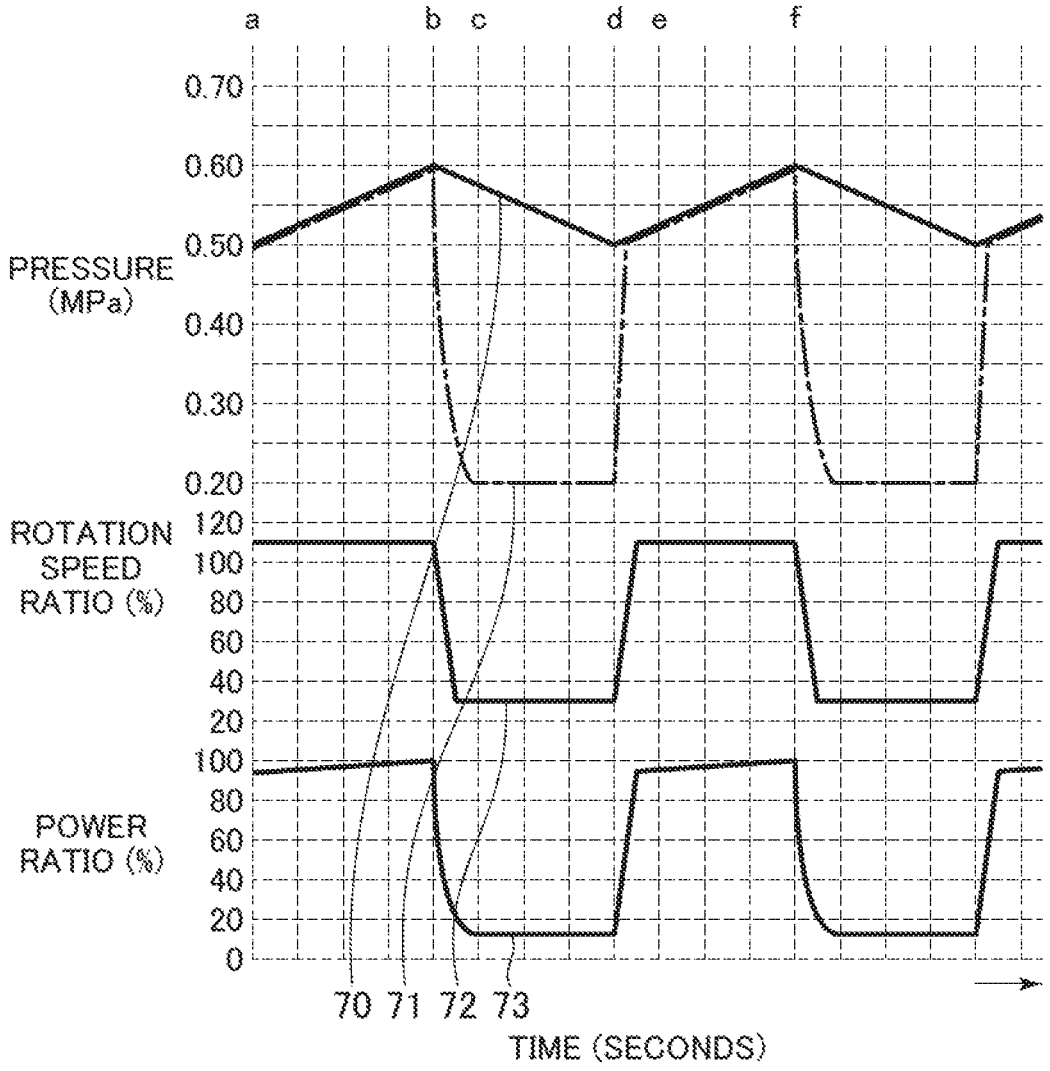
FIG. 10 is a time chart of capacity control of the air compressor of embodiment 7.

FIG. 10 is a time chart of capacity control of an air compressor of an embodiment 7.

In FIG. 10, suppose that here (ab+bd)/T2=1. The compressor rotation speed ratio in the period from the time a to b and the period from the time d to f is always 107% at the time of high speed and the power ratio becomes 100% when the discharge pressure 70 is the pressure setting H.

The compressor rotation speed ratio when the pressure setting H is 0.6 MPa is 107% and exceeds 100%, which is the compressor rotation speed ratio when the pressure setting H is 0.7 MPa. However, this is a relative expression and even 107% does not mean overload.

As above, according to the present embodiment, in the compressor 100 that operates with constant-speed control, significant energy saving can be intended by reducing the rotation speed of the compressor at the time of "unload control operation." In addition, even when the pressure setting is set low, the amount of air discharged can be increased almost without causing the power ratio 73 to exceed 100%.

Although the modes for carrying out the present invention are described above, the present invention is not limited to the above-described embodiments and replacement and change can be made in such a range as not to depart from the gist thereof.

For example, although the description is made by taking the air compressor as an example in the above-described examples, the present invention can be applied also to a compressor that compresses another gas. Furthermore, as the compressor main unit 1, a compressor of a displacement type or turbo type can be applied. The displacement type includes a rotary system and a to-and-fro motion system. The rotary system includes scroll, vane, and claw systems and the to-and-fro motion system includes a reciprocating system. In addition, the compressor includes a liquid-feed-type compressor that supplies a liquid such as water or oil to a compression working chamber and a no-liquid-feed-type compressor and may be a compressor of a single-stage or multiple-stage configuration.

Moreover, although the description is made by taking the electric motor 2 as an example as the drive source, the electric motor 2 may be an internal combustion engine. In this case, the multi-speed device 3 carries out control of the rotation speed by gear change or increase/decrease in supplied fuel.

DESCRIPTION OF REFERENCE CHARACTERS

1: Compressor main unit
2: Electric motor
3: Multi-speed device
4: Controller
5: Intake throttle valve
6: Intake filter
8: Check valve
9: Pressure sensor (pressure detecting means)
13: Solenoid valve
14: Gas release valve
15: Air tank
16: Air filter
17: End pressure sensor of a piping system
18: End of a piping system
19: Pressure loss ΔP
20: Operation input I/F
70: Discharge pressure (secondary side of check valve 8)
71: Internal pressure (primary side of check valve 8, secondary side of compressor main unit 1)
72: Compressor rotation speed ratio
73: Power ratio
74: End pressure
100: Air compressor (compressor)

The invention claimed is:

1. A gas compressor comprising:

a compressor main unit that compresses a gas;

a drive source that drives the compressor main unit;

an intake throttle valve that adjusts an amount of gas intake of the compressor main unit;

a gas release valve that releases a discharged gas of the compressor main unit to an atmospheric pressure environment;

rotation speed converting means that changes a rotation speed of the drive source;

a pressure detecting device that detects a discharge pressure of a discharged gas system, wherein H is an upper-limit pressure and L is a lower-limit pressure and H>L; and a controller that carries out opening the intake throttle valve and closing the gas release valve and operating the drive source at a full-load rotation speed until the discharge pressure reaches the upper-limit pressure H, and carries out at least one of closing the intake throttle valve and opening the gas release valve to reduce the discharge pressure when the discharge pressure reaches the upper-limit pressure H, and carries out switching to a different mode when the discharge pressure drops to the lower-limit pressure L, wherein the controller outputs a command of a lower rotation speed than the full-load rotation speed to the rotation speed converting means when the discharge pressure rises and reaches the upper-limit pressure H, the controller outputs a command of the full-load rotation speed to the rotation speed converting means when the discharge pressure drops and reaches the lower-limit pressure L, and the gas compressor includes an end pressure detecting device that detects a pressure of an external piping system that connects to the discharged gas system, wherein the controller carries out opening-closing operation of at least one of the intake throttle valve and the gas release valve and outputs a command of the lower rotation speed and a command of the full-load rotation speed to the rotation speed converting means according to pressures obtained by subtracting a pressure loss of the external piping system based on a detected pressure of the end pressure detecting device from the upper-limit pressure H and the lower-limit pressure L.

2. The gas compressor according to claim 1, wherein according to a time ratio between: i) a time until the discharge pressure rises from the lower-limit pressure L to the upper-limit pressure H, and ii) a time until the discharge pressure reaches the lower-limit pressure L through execution of at least one of closing the intake throttle valve and opening the gas release valve when the discharge pressure reaches the upper-limit pressure H, the controller changes the upper-limit pressure H at which the intake throttle valve is closed and the gas release valve is subsequently opened.

3. The gas compressor according to claim 1, wherein the controller calculates a lowering of the discharge pressure from a discharge pressure lowering value per unit time, and when a time until a drop to the lower-limit pressure L based on lowering falling within a predetermined approximation range with a time until the drive source reaches the full-load rotation speed from the lower rotation speed than the full-load rotation speed, the controller outputs a command of the full-load rotation speed to the rotation speed converting means before the discharge pressure drops to the lower-limit pressure L.

4. The gas compressor according to claim 1, wherein the controller outputs a command of the lower rotation speed to the rotation speed converting means after elapse of a predetermined time or after a drop to a predetermined pressure after the intake throttle valve is closed and the gas release valve is opened according to the pressure obtained by subtracting the pressure loss of the external piping system from the upper-limit pressure H.

5. The gas compressor according to claim 1, wherein the controller has a function of calculating a discharge pressure lowering value per unit time and a function of storing a quadratic expression, the controller sets a pressure setting H' equal to the upper-limit pressure H and sets a pressure setting L' equal to the lower-limit pressure L when the discharge pressure lowering value is 0, and sets the pressure setting H' to a value obtained by lowering by a pressure value stored in advance from the upper-limit pressure H and sets the pressure setting L' to a value obtained by lowering by a pressure value stored in advance from the lower-limit pressure L when the discharge pressure lowering value is equal to or larger than a certain constant value, and carries out calculation of a quadratic expression on difference of the pressure setting H' and the pressure setting L' and the discharge pressure lowering value, the controller carries out at least one of opening the intake throttle valve and closing the gas release valve and outputs a command of the full-load rotation speed to the rotation speed converting means when the discharge pressure lowers and reaches the pressure setting L', and the controller carries out at least one of closing the intake throttle valve and opening the gas release valve and outputs a command of the lower rotation speed to the rotation speed converting means when the discharge pressure rises and reaches the pressure setting H'.

6. The gas compressor according to claim 1, wherein the controller has a function of storing a relationship with which power falls within a certain range, the relationship between the discharge pressure and the rotation speed of the drive source, the controller sets the rotation speed lower in such a manner that the power is set within the certain range when the discharge pressure in full-load rotation of the drive source is higher than a first value, and the controller sets the rotation speed higher than a second value in such a manner that the power is set within the certain range when the discharge pressure in the full-load rotation of the drive source decreases.

7. The gas compressor according to claim 1, wherein the controller stores a relationship among the upper-limit pressure H, the lower-limit pressure L, and the rotation speed of the drive source in such a manner that power in a full-load operation mode when the upper-limit pressure and the discharge pressure are equal is same as power of full-load rotation speed when the discharge pressure is the upper-limit pressure H and is equal to a specification pressure of the gas compressor, when the upper-limit pressure H and the lower-limit pressure L are higher than the specification pressure of the gas compressor, the controller carries out at least one of opening the intake throttle valve and closing the gas release valve and outputs a command to lower the rotation speed to the rotation speed converting means in such a manner that power when the drive source is driven at the full-load rotation speed falls within a certain range, and when the upper-limit pressure H and the lower-limit pressure L are lower than the specification pressure of the gas compressor, the controller carries out at least one of opening the intake throttle valve and closing the gas release valve and outputs a command to raise the rotation speed to the rotation speed converting means in such a manner that the power when the drive source is driven at the full-load rotation speed falls within the certain range.

* * * * *